US005090604A

United States Patent [19]

Howe

[11] Patent Number: 5,090,604

[45] Date of Patent: Feb. 25, 1992

[54] BACKPACK DEVICE

[75] Inventor: Robert Howe, Oakland, Calif.

[73] Assignee: The North Face, Berkeley, Calif.

[21] Appl. No.: 557,515

[22] Filed: Jul. 24, 1990

[51] Int. Cl.[5] ..... A45F 3/08

[52] U.S. Cl. ..... 224/211; 224/215; 224/224

[58] Field of Search ..... 224/211, 210, 209, 212, 224/213, 215, 222, 224, 262, 261, 263

[56] References Cited

U.S. PATENT DOCUMENTS

| | | | |
|---|---|---|---|
| 204,066 | 5/1878 | Merriam | 224/213 X |
| 1,723,147 | 8/1929 | Fourethier | 224/211 X |
| 3,923,216 | 12/1975 | Farnbach | 224/211 |
| 4,018,370 | 4/1977 | Wood | 224/263 |
| 4,133,464 | 1/1979 | Kelty | 224/262 |
| 4,189,076 | 2/1980 | Zufich | 224/211 |
| 4,194,656 | 5/1980 | Zufich | 224/211 |
| 4,217,998 | 8/1980 | Alexander | 224/261 |
| 4,369,903 | 1/1983 | Wilkes | 224/213 |
| 4,489,866 | 12/1984 | Korte | 224/155 |
| 4,827,578 | 5/1989 | Heckerman et al. | 224/150 X |
| 4,844,307 | 7/1989 | Rutledge | 224/211 |
| 4,976,387 | 12/1990 | Spianti | 224/211 X |

FOREIGN PATENT DOCUMENTS

| | | | |
|---|---|---|---|
| 797075 | 10/1968 | Canada | 224/263 |
| 13605 | of 1908 | United Kingdom | 224/209 |
| 450658 | 7/1936 | United Kingdom . | |

*Primary Examiner*—Henry J. Recla
*Assistant Examiner*—Glenn T. Barrett
*Attorney, Agent, or Firm*—Limbach & Limbach

[57] ABSTRACT

A backpack device including a flexible enclosure for containing a load to be supported and carried by a wearer and a frame for supporting the flexible enclosure. Shock absorbers are pivotally connected to the frame and to a waist belt for absorbing shock between the flexible enclosure and the wearer.

3 Claims, 1 Drawing Sheet

BACKPACK DEVICE

TECHNICAL FIELD OF INVENTION

The present invention deals with backpack devices which possess a flexible enclosure for containing a load to be supported and carried by a wearer. The load exerted upon the wearer of the backpack is now capable of being more comfortably carried as shock absorbing elements are provided between the backpack and the hips of the wearer.

BACKGROUND OF THE INVENTION

Great strides have been made since the introduction of the ladder or H-type backpack frame. Initially, such frames were employed to be supported by one's back to which was lashed articles to be carried. Such frames consisted of generally vertically extending metal, wood, plastic or similar materials possessing a pair of forwardly extending shoulder straps, each strap forming a loop with the rear frame. A belt was also employed to maintain the bottom of the frame against the lower back of the user. The result of all of this was to require the wearer to lean forward while wearing the backpack in order to shift the pack's center of gravity, all of which resulted in making its wearing uncomfortable and tiring.

Devices such as those disclosed in U.S. Pat. No. 4,219,998 entails the use of various support members which cause the center of gravity of the backpack to shift forward relieving its wearer of experiencing the off-balance pulled back sensation previously experienced.

It was also recognized that advantages in backpack comfort could be realized by removing the backpack load from the shoulder straps and transferring it to the hip area well below the backpack's center of gravity. Such devices are shown, for example, in U.S. Pat. No. 4,369,903.

As backpack devices have become more elaborate, there has further been a recognition that an improved product could be configured by providing independent movement between the user and the load renderers. For example, U.S. Pat. No. 4,189,076 provides a device whereby a belt is adapted to be disposed about the waist of the user, the belt including downward extending load support panel which is adapted to be coupled to the load at a point which is substantially below the waist. A rigid support member or yoke is coupled to the lower portions of the supporting which extends about the rear of the user. The pack frame is taught to be pivotally coupled to the yoke in a manner which will permit the user to have normal rotational hip action without being unduly retarded by the load being carried.

Although one can track various improved designs through time, there is yet to be developed a backpack device which is capable of not only shifting the load of the pack to the hip or waist area but also which is capable of absorbing shocks which are normally present during routine movement of the user wearing the backpack.

The present invention can be more readily visualized when considering the following disclosure and appended drawing wherein the sole figure is a side view of the backpack device of the present invention shown on the silhouette of a wearer.

SUMMARY OF THE INVENTION

The present invention is to a backpack device comprising of flexible enclosure for containing a load to be supported and carried by a wearer of said device. A frame for supporting the flexible enclosure is provided which includes a pair of vertically extending tubular struts located at the sides of the flexible enclosure. A waist belt means for encircling the waist of the wearer is provided which is also connected to the flexible enclosure. Sliding connector means adapted to slide along each of the vertically extending tubular struts are, in turn, pivotally connected to shock absorbing means which, themselves, are pivotally connected to the waist belt means. The shock absorbing means are provided to absorb shock between the flexible enclosure and the wearer.

DETAILED DESCRIPTION OF THE INVENTION

Figures 1, 2:
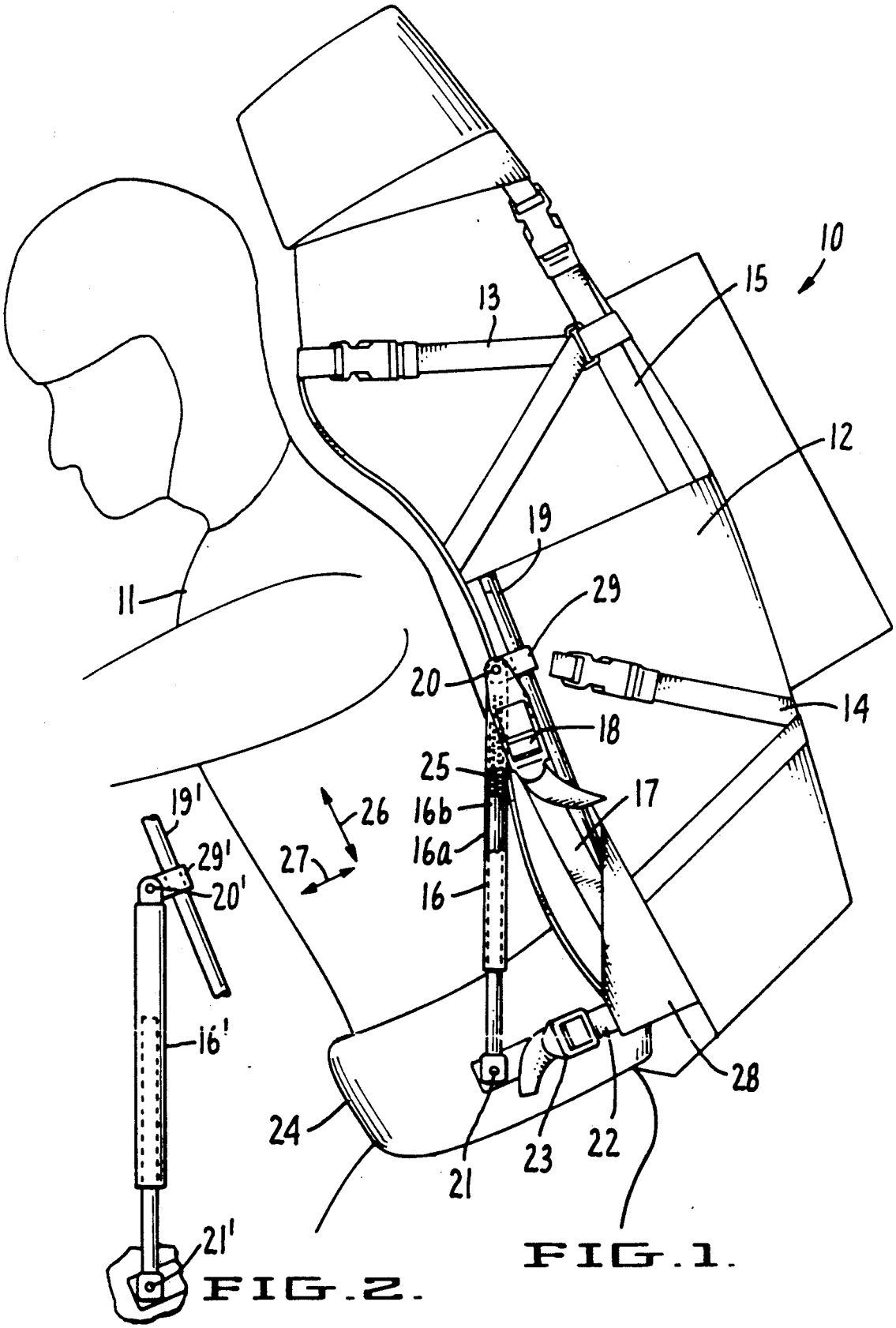
FIG. 1 is a perspective view of one embodiment of the invention wherein the shock absorbing element includes a spring element.
FIG. 2 is a partially schematic view of another embodiment of the invention wherein the shock absorbing element includes a hydraulic fluid cylinder.

Referring to FIG. 1, backpack device 10 is shown being supported by wearer 11. Flexible enclosure 12 typically is composed of a number of subparts containing such items as portable tents, sleeping bags and eating utensils which traditionally make up the contents of a backpack. These various subsections are usually held firmly in place through the use of adjustable straps 13, 14 and 15, the Configuration and positioning of which constituting no part of the present invention.

Although a shoulder harness can be used in conjunction with the device depicted in the appended figure, it has not been shown for the sake of illustrating the present invention with clarity. In wearing backpack 12, wearer 11 generally experiences vertical and horizontal force vectors 26 and 27, respectively, which are shifted off their vertical and horizontal axes as the wearer leans forward. Nevertheless, as wearer 11 walks or performs other movements while wearing backpack 12, the pack's weight exerts horizontal and vertical force vectors which must be dealt with.

Although waist belt 24 helps to support the weight of pack 12 at the hip region of wearer 11, each time a step is taken the wearer experiences a shock as a result of the momentum of pack 12 along vectors 26 and 27. The present invention is intended to substantially reduce the shock by providing shock absorber 16 as illustrated. Shock absorber 16 is pivotally connected to sliding connector 29 by pin or bolt 20 at one extreme and at the waist belt 24 at connector 21. The shock absorber element can be typically telescoping tubes 16A and 16B containing spring means 25 for absorbing shock between movement of said tubes. Alternatively, shock absorbing element 16 can comprise a fluid cylinder means whereby hydraulic fluid is employed for absorbing shock between movement of cylinders. As shock absorbers, both designs are quite conventional and well known in other environments.

It is readily apparent that shock absorber 16 represents the hypotenuse of a right angle triangle whose base is force vector 27 and whose vertical axis is force vector 26. As such, as shock absorbing element 16 expands and contracts in response to the relative motion between backpack 12 and wearer 11, both vertical and horizontal forces are absorbed providing a much more comfortable product capable of being worn for extended lengths of time without fatigue.

It is noted that sliding connector means 29 is capable of movement along vertically extending tubular strut 19. Although not shown, a corresponding strut and sliding connector means are provided on the other side of the pack to support a corresponding shock absorber means 16. Sliding connector means 29 is held in position by strap 17 whose length can be adjusted along vertically extending tubular strut 19 via adjustment buckle 18.

The adjustability of sliding connector 29 through the use of strap 17 and buckle 18 further enhances the practical utility of the present invention. More specifically, by varying the position of sliding connector 29, one can change the angle of shock absorber 16 to vectors 27 and 26, thus changing the positioning of the backpack 12 with respect to user 11. During long hikes, an occasional shift in position can act to relieve muscles of the user. In addition, most human torsos are not perfectly symmetrical and having separate adjustments for the left and right sides of the pack enables the wearer to "fine tune" the present device for a specific torso configuration.

The bottom of the backpack is generally provided with support fabric 28 which is employed as a connector for strap 22 and adjustment buckle 23. These elements act to transmit the forces of vector 27 while force vector 26 is transmitted along vertically extending tubular strut 19.

FIG. 2 illustrates still another embodiment of the invention. The shock absorbing element 16' has a cylinder **16*a*' filled fluid 25' and designed to be pivotally attached at connector 21' to the waist-belt means 24 (see FIG. 1). Shock absorbing element 16' is further pivotally attached to the sliding connector 29' by pin 20' such that element 16' is further pivotally attached to the sliding connector 29' by pin 20' such that element 16' may be slideably moved along the vertically extending strut 19'**.

The invention has been described with specific reference to certain specific embodiments; however, it is to be understood that applicant's invention is not intended to be so limited and it is intended that applicant's invention is only to be limited by the following claims.

I claim:

1. A Backpack device comprising a flexible enclosure for containing a load to be supported and carried by a wearer of said device, a frame for supporting said flexible enclosure, said frame including a pair of vertically extending tubular struts located at two sides of said flexible enclosure, waist belt means for encircling the waist of the wearer being attached to said flexible enclosure, said frame further comprising sliding connector means adapted to slide along each of said vertically extending tubular struts, shock absorbing means, including telescoping tubes containing a spring means for absorbing shock between movement of said tubes, pivotally connected to each of said sliding connector means, and to said waist belt means to absorb shock between said flexible enclosure and the wearer as the wearer supports said backpack device.

2. A Backpack device comprising a flexible enclosure for containing a load to be supported and carried by a wearer of said device, a frame for supporting said flexible enclosure, said frame including a pair of vertically extending tubular struts located at two sides of said flexible enclosure, waist belt means for encircling the waist of the wearer being attached to said flexible enclosure, said frame further comprising sliding connector means adapted to slide along each of said vertically extending tubular struts, shock absorbing means, including fluid cylinder means containing cylinders and hydraulic fluid for absorbing shock between movement of said cylinders, pivotally connected to each of said sliding connector means, and to said waist belt means to absorb shock between said flexible enclosure and the wearer as the wearer supports said backpack device.

3. A Backpack device comprising a flexible enclosure for containing a load to be supported and carried by a wearer of said device, a frame for supporting said flexible enclosure, said frame including a pair of vertically extending tubular struts located at two sides of said flexible enclosure, waist belt means for encircling the waist of the wearer being attached to said flexible enclosure, said frame further comprising sliding connector means adapted to slide along each of said vertically extending tubular struts, shock absorbing means pivotally connected to each of said sliding connector means, and to said waist belt means to absorb shock between said flexible enclosure and the wearer as the wearer supports said backpack device and wherein straps, adjustable in length, are connected between said sliding connector means and said flexible enclosure for adjustably limiting movement of said sliding connector means along said vertically extending tubular struts.

* * * * *